United States Patent [19]

Corbett et al.

[11] Patent Number: 4,561,367

[45] Date of Patent: Dec. 31, 1985

[54] LOCKSTITCH SEWING MACHINE

[75] Inventors: John Corbett, Aspley Guise; Edric M. E. Brown, Milton Keynes; Peter N. Tapner, Twickenham; David J. Commander, Milton Keynes, all of England

[73] Assignee: USM Corporation, Farmington, Conn.

[21] Appl. No.: 648,657

[22] Filed: Sep. 7, 1984

[30] Foreign Application Priority Data

Sep. 8, 1983 [GB] United Kingdom ..... 8324063

[51] Int. Cl.[4] ..... D05B 15/08

[52] U.S. Cl. ..... 112/38; 112/239; 112/242; 112/274

[58] Field of Search ..... 112/38, 37, 42, 48, 112/239, 274, 275, 242

[56] References Cited

U.S. PATENT DOCUMENTS

| | | | |
|---|---|---|---|
| 1,498,650 | 6/1924 | Fletcher | 112/38 |
| 2,015,654 | 10/1935 | Ashworth | 112/38 |
| 2,780,188 | 2/1957 | Schaefer, Jr. et al. | 112/38 |
| 2,928,361 | 3/1960 | Ashworth et al. | 112/38 X |

FOREIGN PATENT DOCUMENTS

| | | | |
|---|---|---|---|
| 410463 | 5/1934 | United Kingdom | 112/38 |

*Primary Examiner*—H. Hampton Hunter
*Attorney, Agent, or Firm*—Donald N. Halgren

[57] ABSTRACT

A lockstitch sewing machine has a needle (22) and awl (24) mounted on a common pivot (52) and actuated each by a crank mechanism (40;72), the two mechanisms being mounted on a common crank shaft (38). Each mechanism is constituted by a bell crank lever (44;76); the two levers also being mounted on a common pivot (46). This latter pivot (46) is disposed intermediate the pivot (52) for the needle and awl and the crank shaft (38).

12 Claims, 8 Drawing Figures

LOCKSTITCH SEWING MACHINE

BACKGROUND OF THE INVENTION (1) Field of the Invention

This invention is concerned with lockstitch sewing machines, especially, but not exclusively, lockstitch sewing machines for use in the shoe industry where, for example, outsoles of thick, tough material, e.g. leather, are stitched to welts in the production of welted shoes.

(2) Prior Art

One such machine is described in UK Patent Specification No. 410463 and comprises a worktable and a presser foot arranged at an operating locality of the machine for clamping a workpiece therebetween and feeding it step-by-step through the operating locality, a mounting for a curved hooked needle and a further mounting for a curved awl arranged in a common vertical plane and at opposite sides of the worktable, at the operating locality of the machine, and mounted for pivotal movement about a common axis, means for looping thread over the needle hook, after the latter has penetrated a workpiece being stitched and while it is projecting therethrough, retraction of the needle then causing the thread to be drawn through the workpiece, means, including a rotatable shuttle, by which a lockstitch can be formed with that thread and a further thread, and means for thereafter drawing the lockstitch thus formed into the body of the workpiece. In such machine, furthermore, the needle mounting and the awl mounting are caused to pivot each by a crank mechanism.

In the machine described in the aforementioned patent specification, the general arrangement of mechanisms is very complex, and in particular the crank mechanism for the needle mounting and awl mounting movements are driven compositely by two separate, but interconnected, crank shafts one of which runs at a substantially higher speed than the other, the arrangement being such that the output of the crank mechanisms, which are mounted on the one crank shaft, are modified by the action of further mechanisms associated with the other of the crank shafts. In operation, this arrangement of two crank shafts has proved highly successful in a high speed machine manufactured and supplied by the applicant company; by "high speed machine" in this context is to be understood a machine capable of operating at over 1000 stitches per minute. However, the arrangement of two crank shafts is clearly expensive in terms of material costs and machining costs, and furthermore, because of the complexity of the arrangement, a great deal of assembly skill is required in building the machines. In addition, not only is a good deal of space required within the machine frame for accommodating this double crank shaft arrangement, but further a relatively large number of pivots is involved, with the consequent problems of tolerances and a general "springiness" in the mechanisms. What is more, in the particular arrangement described in the aforementioned patent specification, an acceleration analysis indicates that the acceleration of various of the integers, notably the needle mounting and the awl mounting, are subject to sharp peaks, which can result in excessive wear and increased noise levels.

It is therefore the object of the present invention to provide an improved lockstitch sewing machine which can operate at a high speed, but the mechanism of which are significantly simplified and rendered more compact, and the peak acceleration of the various components are "rounded" so as to enhance wear and reduce noise levels.

BRIEF SUMMARY OF THE INVENTION

The invention thus provides a lockstitch sewing machine comprising a worktable and a presser foot arranged at an operating locality of the machine for clamping a workpiece therebetween and for feeding such workpiece step-by-step through the operating locality, a mounting for a curved hooked needle and a further mounting for a curved awl arranged in a common vertical plane and at opposite sides of the worktable, at the operating locality of the machine, and mounted for pivotal movement about a common axis, means for looping thread over the needle hook after the latter has penetrated a workpiece being stitched and while it is projecting therethrough, retraction of the needle then causing the loop of thread to be drawn through the workpiece, means including a rotatable shuttle, by which a lockstitch can be formed with the thread and a further thread, and means for thereafter drawing the lockstitch thus formed into the body of the workpiece, wherein the needle mounting and the awl mounting are caused to pivot each by a crank mechanism, and further wherein the mechanisms are mounted on a common crank shaft and each is operatively connected to its associated mounting through a bell crank lever arrangement, these arrangements being mounted on a common pivot arranged intermediate the crank shaft and the common axis of the mountings for the needle and awl.

It will thus be appreciated that the arrangement of crank mechanisms for the needle mounting and awl mounting is significantly simplified, utilizing a single common crank shaft and utilizing also a relatively small lever arrangement in the case of each mounting. Furthermore, by the reduction in the size of the two mechaniims, and further by mounting the two lever arrangements on a common pivot arranged intermediate the crank shaft and the common axis of the mountings, a relatively "stiff" arrangement is afforded. This is achieved not only by compactness, but further because the various pivots can now be arranged in a single casting because of their proximity with one another (as opposed to the earlier arrangement, in which in general different pivots were mounted in different castings over the height of the machine). Further in utilizing the arrangement in accordance with the invention, it has been found possible to reduce the peaks in acceleration of the various components, thereby contributing towards reduction in wear and also reduction of noise levels. At the same time, the arrangement enables the bell crank levers and the crank mechanisms to be maintained closely adjacent to the common vertical plane of the needle mounting the awl mounting, thereby enabling the machine to be operated at high speed.

Further to facilitate the arrangement of the crank mechanisms and bell crank levers referred to above, the crank shaft extends horizontally and transversely of the machine.

The machine preferably comprises a mounting for a needle guide mounted for pivotal movement also about the common axis of the mountings for the needle and awl. In order to enhance the compactness of the machine a cam arrangement is preferably provided, which is also mounted on the crank shaft and is operatively connected through a linkage arrangement with the needle guide mounting, for effecting pivotal movement thereof about the axis in timed relation with movement of the needle mounting.

Because of the complex nature of the crank shafts of the machine described in the aforementioned patent specification, a relatively complicated drive arrangement was also provided. Furthermore, the mechanisms of the machine were as a whole mechanically controlled, requiring relatively complex mechanisms for controlling the rotation of the crank shaft, and in particular for ensuring that the end of a stitching cycle (i.e. the end of a series of stitches) came about with the needle and awl out of penetrating engagement with the workpiece. In the machine in accordance with the invention, a simplified drive arrangement can be utilized, comprising an arrangement of timing pulleys operatively connected by a timing belt. Furthermore, for controlling the operation of the crank shaft, which is driven, through the arrangement of pulleys and belt, by means of a braked motor, the crank shaft preferably supports a shaft encoder forming part of control means of the machine, by which means the operation of said motor is so controlled that the crank shaft is brought to rest, upon receipt of an "end of cycle" signal by the control means, with the mountings for the needle and awl so positioned that a needle and an awl respectively supported thereby are out of penetrating engagement with the workpiece. It will be appreciated that by this combination of drive arrangement and shaft encoder the control of the rotation of the crank shaft has been significantly simplified and rendered significantly less expensive, while retaining reliability in the drive arrangement and control means within acceptable limits.

In the machine described in the aforementioned patent specification, the thread looping means referred to above comprises a looper through an aperture of which the thread passes, the looper being mounted for movement about the needle, when the latter is projecting through and beyond the work, under the control of two separate cam mechanisms giving rise to movement of the looper about two separate axes. This arrangement, apart from necessitating two sets of parts, also requires the space for accommodating such parts and gives rise to a need for assembly skill in the initial setting up of the machine. In accordance with the present invention, therefore, the thread looping means has been simplified in that the looper is preferably now mounted for pivotal movement about an axis inclined at some 25° to the vertical. Thus, one of the two axes has now been dispensed with, the inclination of the remaining axis compensating for the absence of the second cam mechanism. For rotating the looper about the inclined axis, furthermore, conveniently cam means is provided on the crank shaft for effecting pivotal movement of the looper as aforesaid, the means being operatively connected to the looper by a toothed segment arrangement.

In the machine described in the aforementioned patent specification cam-operated means is provided for bringing the presser foot into clamping arrangement with a workpiece supported by the worktable and for supporting it against the thrust of the awl as the latter penetrates the workpiece in the operation of the machine, the means comprising a lock arrangement which, in an unlocked condition, allows relative sliding movement between components thereof whereby the cam-operated means can accommodate to the thickness of the workpiece being clamped, but which, in locked condition, locks the components against such movement. Furthermore, at the end of a stitching cycle of the machine, in addition to the machine being brought to rest in a desired condition as referred to above, the presser foot is raised out of clamping engagement with the workpiece and at the same time the lock arrangement is released, this being achieved by cam-operated means. In the machine in accordance with the invention, the cam-operated means last referred to is preferably replaced by an electrically operated linear motor operable through a linkage arrangement, in response to an "end of cycle" signal, to raise the presser foot out of clamping engagement at the end of a stitching operation and to cause the lock arrangement to be released. In a preferred embodiment, furthermore, the linear motor is operated after the crank shaft has been brought to rest as aforesaid. By using an electrically operated linear motor a number of relatively complicated mechanical linkages are dispensed with, while a positively operating unit replaces them. Furthermore, the use of an electrically operated linear motor fits in with the electrical control means referred to above.

Again in the machine described in the aforementioned patent specifications, means for supplying thread to the needle is provided comprising first thread clamping means operable in conjunction with a thread measuring device and arranged "downstream" of the latter, the arrangement being such that the clamping means is operated to clamp the thread while a measured quantity is drawn from a supply thereof by the measuring device, and second thread clamping means, arranged "upstream" of the first clamping means, for clamping the thread after the measured quantity has been drawn as aforesaid, the second means remaining in thread clamping condition during stitch formation, during which the first means leaves the thread unclamped. Furthermore, in the machine, upon release of the presser foot as described above, the second thread clamping means is also released. In the machine in accordance with the invention, the linear motor directly serves also to release the second thread clamping means in response to that "end of cycle" signal. This can conveniently be achieved using a Bowden cable arrangement operated directly by the linear motor. Again, by using such an arrangement complicated mechanisms can readily be avoided.

Also in the machine described in the aforementioned patent specification, a thread take-up arrangement is provided by which the quantity of thread drawn from a supply is controlled during stitch formation, and by which also a formed stitch can be drawn into the body of the workpiece, by pulling on the needle thread while the latter is held clamped by the second thread clamping means, such drawing of the formed stitch taking place as the awl is moved into penetrating engagement with the workpiece at the start of the formation of the next stitch. Thus, where the final stitch has been formed in a machine cycle, a completely set stitch cannot be produced by the machine, and in practice the operator tends to apply a pull by hand to ensure that the stitch becomes properly set prior to severing the thread.

In the machine in accordance with the present invention, for the final stitch formed in a machine cycle, stitch setting means is provided which, in response to the "end of cycle" signal, is caused to pull on the needle thread to draw the formed stitch into the body of the workpiece, the arrangement being such that the second thread clamping means is released only after the operation of the stitch setting means is completed. In this way, the stitch setting, even for the final stitch, is achieved by the operation of the machine. Moreover, conveniently the stitch setting means is operated by an electrically operated motor, e.g. a solenoid, which can be controlled through the control means in response to the "end of signal" supplied thereto.

It will thus be appreciated that, in the machine in accordance with the invention, while the performance levels achieved by the machine described in the aforementioned patent specification have been maintained, significant simplication has been made, bringing with it significant savings in material costs and machining costs, as well as facilitating assembly of the machine, while at the same time there has been a move towards reducing problems of wear of the various components, especially in those areas which previously suffered from high peak accelerations, and also towards reducing noise levels.

BRIEF DESCRIPTION OF THE DRAWINGS

There now follows a detailed description, to be read with reference to the accompanying drawings, of one machine in accordance with the invention, which machine, it will be appreciated, has been selected for description merely by way of exemplification of the invention and not by way of limitation thereof.

In the accompanying drawings.

DESCRIPTION OF THE PREFERRED EMBODIMENT

Figure 5:
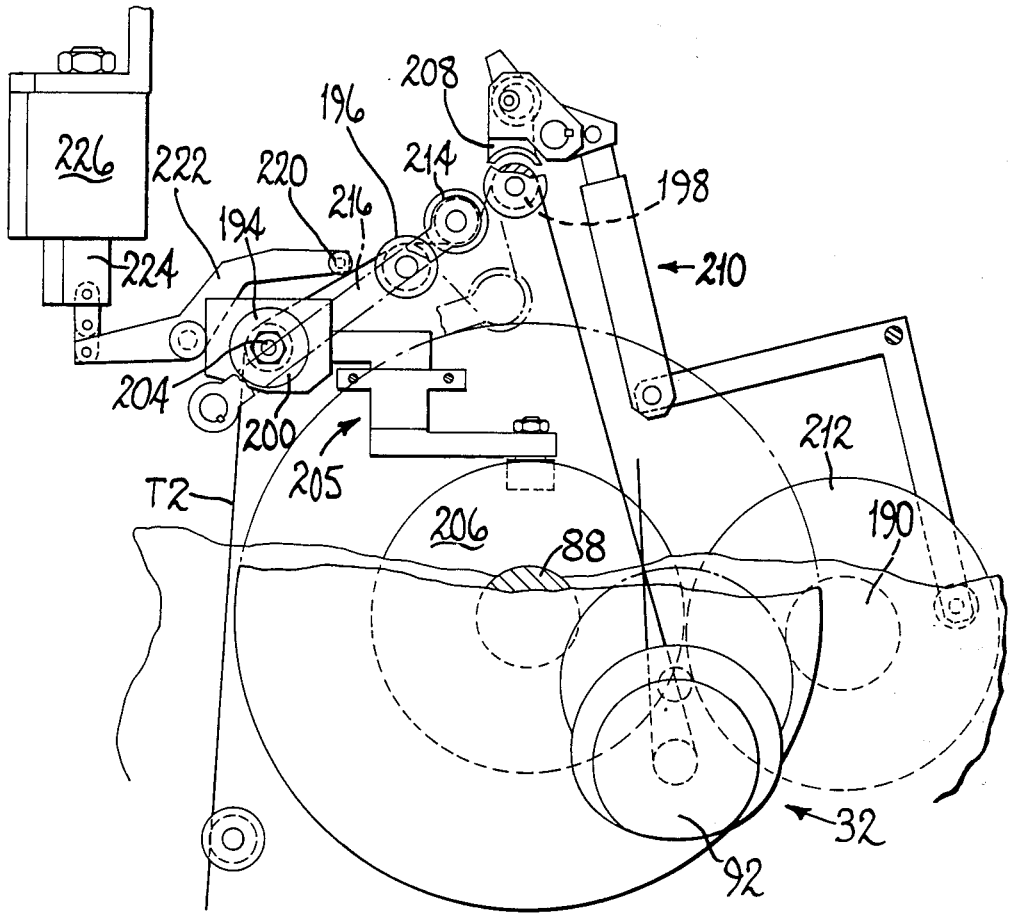
FIG. 5 is a fragmentary front view of the machine, showing details of various integers controlling the supply of running thread, including stitch setting means.

The machine in accordance with the present invention is generally similar, except as hereinafter described, to the machine described in UK Patent Specification No. 410463 and is for use in sewing outsoles of welted shoes to the welts of such shoes by a lockstitch seam. The machine thus comprises stitch forming instrumentalities comprising a curved needle 20, a needle guide 22 and an awl 24. For feeding the two threads T1, T2 required for lockstitch formation, a shuttle arrangement generally designated 26 is provided for the bobbin thread T1, and a feed arrangement for the so-called needle or running thread T2 is provided, this latter arrangement comprises thread measuring means generally designated 28 (FIG. 5), a so-called looper 30 and a thread take-up arrangement generally designated 32. For ensuring that the running thread is reliably engaged by the needle, for drawing through the work, furthermore a so-called thread hook (not shown) is provided, and similarly, for ensuring that the shuttle arrangement 26 takes up the running thread T2, after it has been drawn through the work, a so-called thread lifter (also not shown is provided. The work, which is constituted by a welt secured to a shoe bottom, together with an outsole to be stitched to said welt, is clamped between a so-called worktable 34 and a presser foot 36, the arrangement being such that the worktable and presser foot are movable together, laterally of the machine, while in clamping engagement with the work to feed the work appropriately, while they are also movable in a return direction, while out of such clamping engagement, during the time when the awl 24 is in penetrating engagement with the work, the worktable 34 being provided with a suitable awl-receiving slot for this purpose. The amount of such lateral movement is adjustable by appropriate adjusting means (not shown). The adjusting means is described in detail in the above-identified UK Patent Specification, while the construction of the shuttle arrangement 26 is described in detail in UK Patent Specification No. 806265. In the operation of the machine, with a workpiece held clamped between the worktable 34 and presser foot 36, firstly the awl 24 is actuated so as to pierce the work, thereby providing an appropriate passage for the needle 20 which is caused to follow the awl into penetrating engagement with the work, as the awl is retracted, the needle guide 22 moving together with the needle over the first part of its movement in order to support the leading end of the needle as it is brought into initial engagement with the work.

Figure 3:
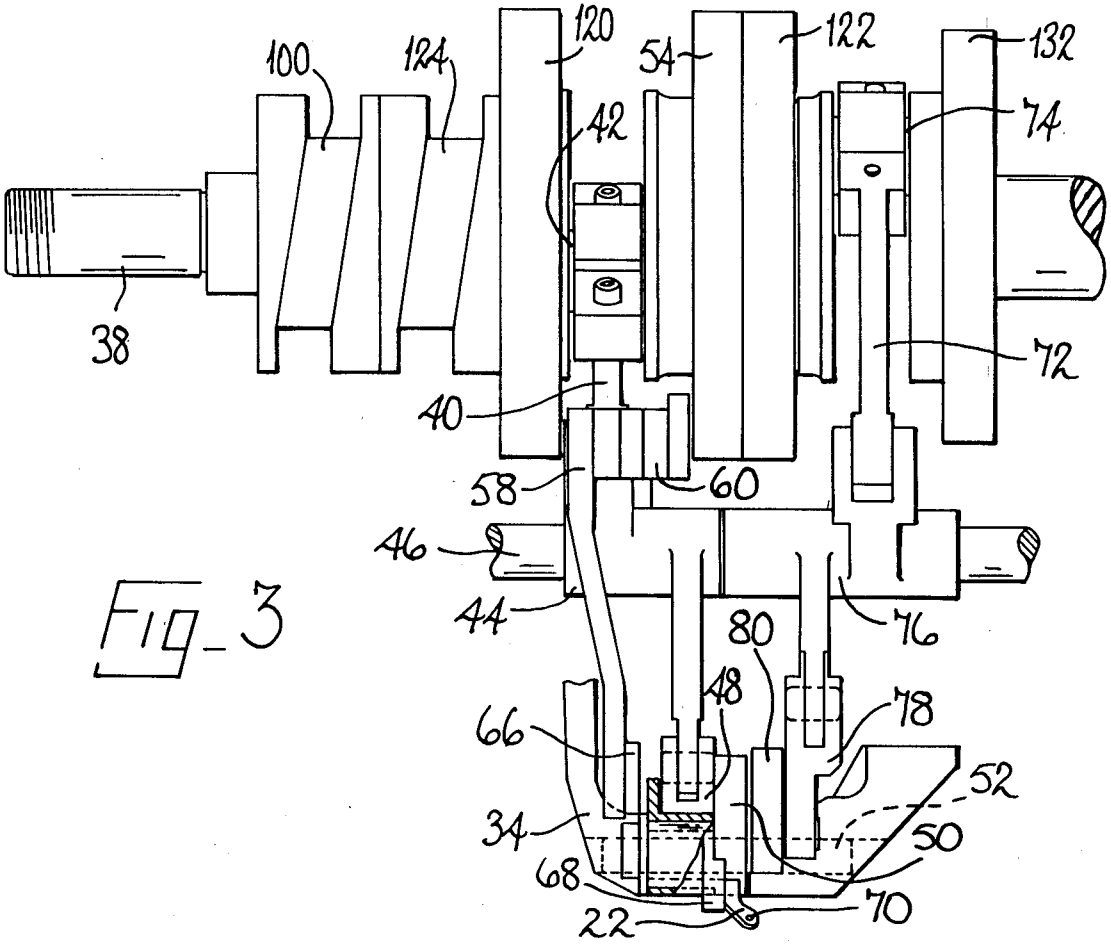
FIG. 3 is a fragmentary view in plan, showing details of a main crank shaft of the machine.
Figure 4A:
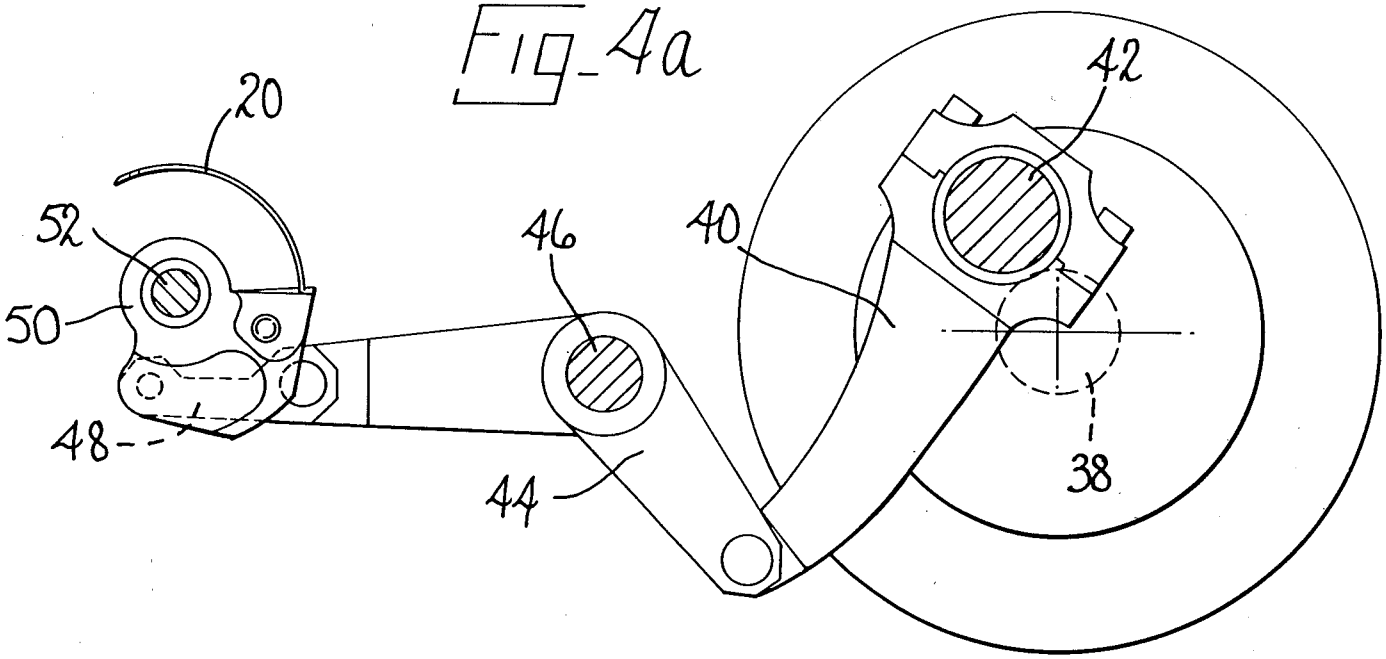
FIGS. 4*a*, 4*b* and 4*c* are detailed views of mechanisms for operating respectively a needle, needle guide and awl of the machine.

In the machine in accordance with the present invention, for actuating the needle 20 and the awl 24 crank mechanisms are provided, and for actuating the needle guide 22 a cam arrangement is provided, mounted on a horizontal laterally extending crank shaft 38, as will now be described with reference to FIG. 3. For actuating the needle 20 (see also FIG. 4*a*) a crank arm 40 is clamped to a pivot pin 42 carried eccentrically on the crank shaft 38, the opposite end of the arm 40 being pivotally connected to one arm of a bell crank lever 44 supported for pivotal movement on a cross-shaft 46 which is carried in the machine frame. The other arm of the bell crank lever 44 is connected to a bifurcated end of a link 48, a remote end of which is in turn pivotally connected to a carrier 50 on which the curve needle 20 is mounted. The carrier 50 is pivotal about a further cross-shaft 52, the axis of which is coincident with the centre of curvature of the curved needle 20.

Figure 4B:
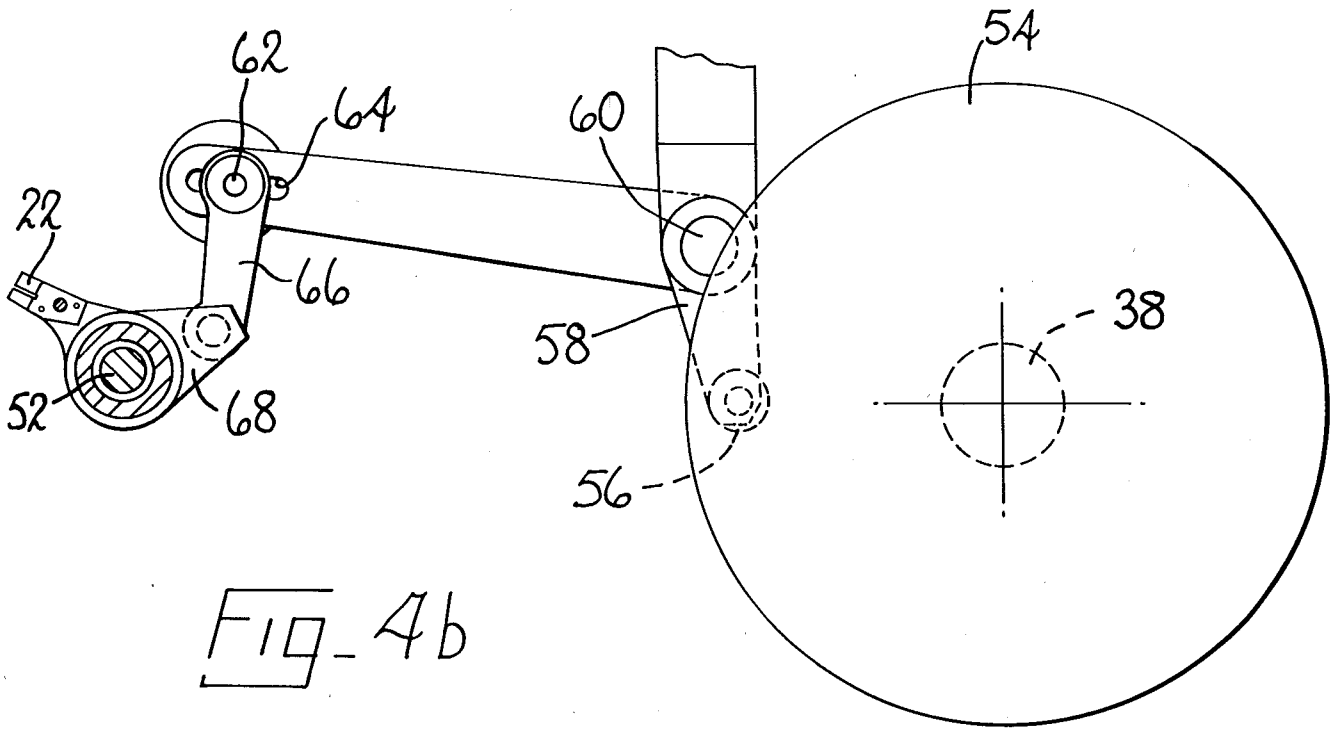

For actuating the needle guide 22 (see also FIG. 4*b*) a cam 54 is mounted on the crank shaft 38, having an enclosed cam path (not shown) in which is captive a cam follower 56 carried by a bell crank lever 58 mounted for pivotal movement on a stub shaft 60 supported by the machine frame. The other arm of the bell crank lever is connected, by a pin (62) and slot (64) connection, to a link 66 which is pivotally connected to a carrier 68 for the needle guide 22. The carrier 68 is mounted for rotation on the cross-shaft 52. The needle guide 22 has an aperture 70 therein to allow the passage therethrough of the needle 20, the passage 70 being spaced from the axis of the cross-shaft 52 by the same distance as the distance of the needle point from said axis.

The needle guide 22 can be rotated about the shaft 52 through an angle of 120°, from an out-of-the-way position to proximity to the work clamped by the presser foot 36 and worktable 34, while the needle can be rotated through an angle of some 254°.

Figure 4C:
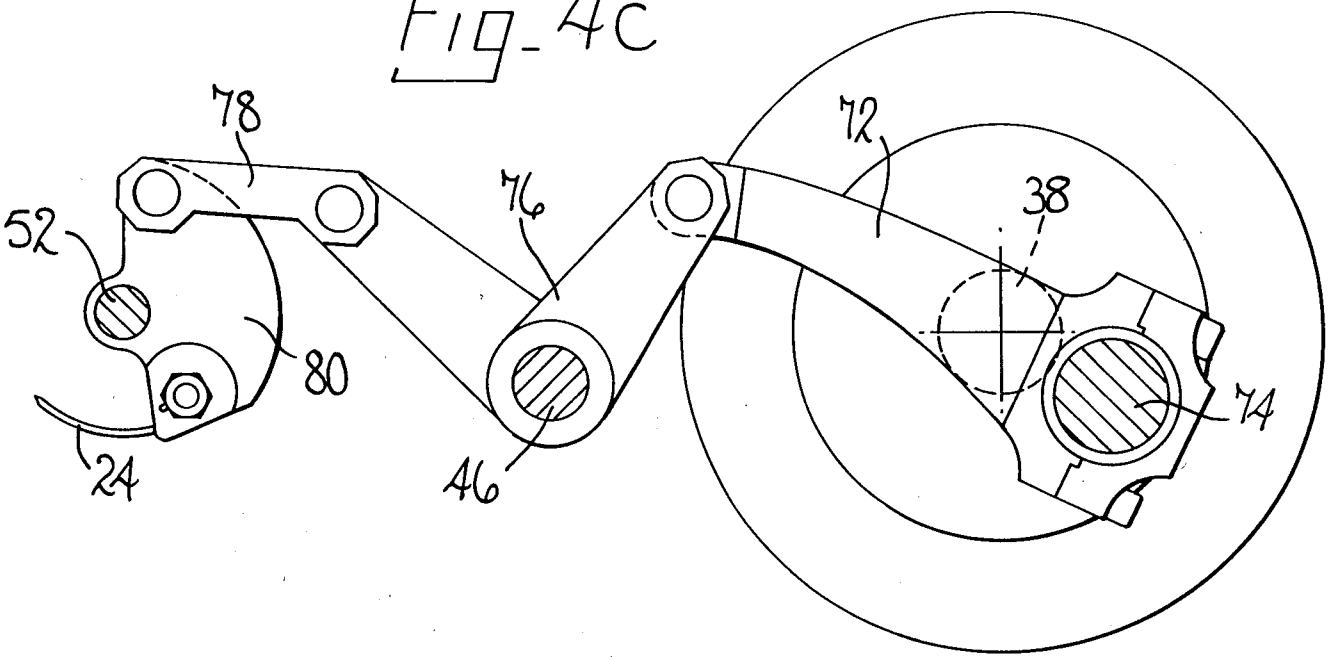

For actuating the awl 24 (see also FIG. 4*c*), a further crank arm 72 is supported by a pivot pin 74 carried eccentrically on the crank shaft 38, the crank arm 72 being connected to a bell crank lever 76 which is mounted for pivotal movement on the cross-shaft 46. The other arm of the bell crank lever 76 is pivotally connected to one end of a link 78 the other end of which is pivotally connected to a carrier 80 for the awl 24. Again, the carrier 80 is supported by the cross-shaft 52, and the distance by which the leading end of the awl 24 is spaced from the axis of said cross-shaft is the same as the distance by which the leading end of the needle 20 is spaced therefrom. It will of course be appreciated that the carriers 50, 80 are arranged to support respectively the needle 20 and the awl 24 in the same vertical plane. Also, as can be seen from FIG. 3, the two crank mechanisms for the needle 20 and awl 24 are disposed closely adjacent said common vertical plane.

For driving the crank shaft 38, a pulley-and-belt arrangement (now shown) is provided, which is operatively connected to the crank shaft 38 through a clutch arrangement (now shown) and which is driven by a main drive motor (also not shown) mounted on the machine frame. The pulley-and-belt arrangement includes a pulley 82 which is carried at one end of a drive shaft (not shown) on which is carried a bevel gear 84 (see FIG. 1) meshing with a further bevel gear 86 which is carried on a shaft 88 extending fore-and-aft of the machine. At the forward end of the shaft 88 is carried a disc 90 which forms part of the thread take-up arrangement 32, and which supports a thread take-up roll 92. Furthermore, the gearing of the pulley-and-belt arrangement is such that the speed of rotation of the crank shaft and that of the shaft 88 are the same, so that the disc 90 of the thread take-up arrangement 32 effects one rotation for each stitch forming operation of the needle 20 and awl 24.

Figure 1:
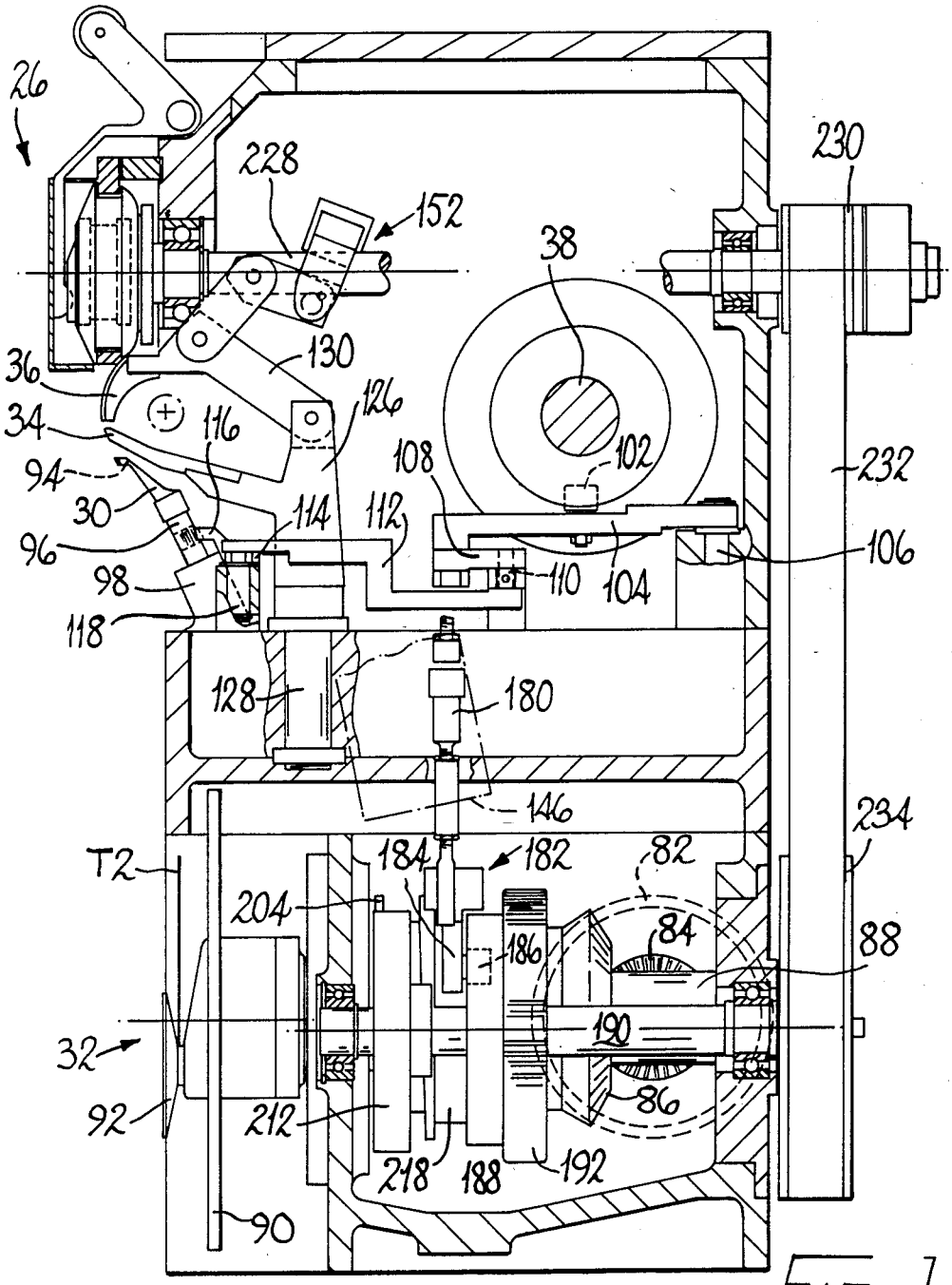
FIG. 1 is a right hand side view, partly in section and with parts broken away, of the machine in accordance with the invention, showing details of a worktable and presser foot of the machine and indicating the general layout of the machine.

The looper 30 is arranged between the take-up arrangement 32 and the worktable 34 and comprises a tubular thread guiding passage 94 through which the running thread T2 passes. The looper 30, in combination with the thread hook (not shown), serves to ensure engagement of the hook of the needle 20 with a loop of the running thread T2 formed therebetween, after the needle 20 has penetrated through the work and is projecting downwardly therebeneath. To this end, the looper is arranged to move transversely of the operating locality of the machine to form the loop and to carry the running thread T2, which is held by the thread hook at one side of the projecting needle 20, over the hook of the needle. For effecting such transverse movement of the looper, the looper is carried on a stem 96 which is mounted for rotational movement about its longitudinal axis, in a bearing 98 forming part of the machine frame. The axis of the stem 96 is inclined at some 25° to the vertical, and furthermore the looper 30 is cut away (as shown in FIG. 1),. whereby, as the looper effects its transverse movement, it remains clear of the projecting needle. For rotating the stem 96, and thus the looper 30, in timed relation with the other operating instrumentalities of the machine, a barrel cam 100 is provided on the crank shaft 38, a cam follower 102 for the cam being mounted on a lever 104 intermediate its length, the lever 104 being carried by a pivot pin 106 supported in the machine frame. The other end of the lever 106 is pivotally connected to a link 108 which is itself secured to a pivot pin 110 mounted also in the machine frame. Also secured to the pivot pin 110 is a crank lever 112, a forward end of which is connected by a link 114 to a toothed segment 116 which is mounted for rotation about a pivot pin 118 also secured in the machine frame. The teeth of the toothed segment 116 mesh with teeth provided on the stem 96 of the looper. In this way, rotation of the crank shaft, and thus of the barrel cam 100 is effective, through the intermeshing teeth, to cause the looper to rotate about the axis of the stem 96. The barrel cam 100 is so constructed that the looper effects a thread-transferring motion in one direction and is then returned to its initial position, once in each stitch forming operation of the machine, the thread-transferring movement being timed to take place while the needle projects downwardly from he work.

For controlling the operation of the thread hook, a further cam 120 is mounted on the crank shaft 38. In this way, the thread hook is caused to operate in timed relation with the looper.

After the thread has engaged over the hook of the needle 20, the needle is then withdrawn upwardly through the work, so that a loop of the running thread T2 is located above the work. In this position, the so-called thread-lifter (not shown) engages in the loop and, in combination with the needle, forms the loop into a triangular shape through which a beak (not shown), forming part of the shuttle arrangement 26, can pass, taking the thread from the hook of the needle 20 and forming the lockstitch therein, as the shuttle arrangement 26 rotates. The movement of the thread lifter is controlled by a further cam 122 on the crank shaft 38 in the aforementioned patent specification, and the construction of the thread lifter mechanism is generally there described (except of course that the crank shaft 38 is horizontal, whereas the corresponding shaft in the earlier machine is vertically disposed).

Also mounted on the crank shaft 38 is a barrel cam 124 by means of which, through a linkage (not shown), the worktable 34, mounted on a bracket 126, is caused to pivot about a vertical axis provided by a pin 128 mounted in the machine frame. Also supported by the bracket 126, in a bifurcated upper end thereof, is a lever 130 supporting the presser foot 36, so that the presser foot moves together with the worktable 34 about the axis of the pin 128.

Figure 2:
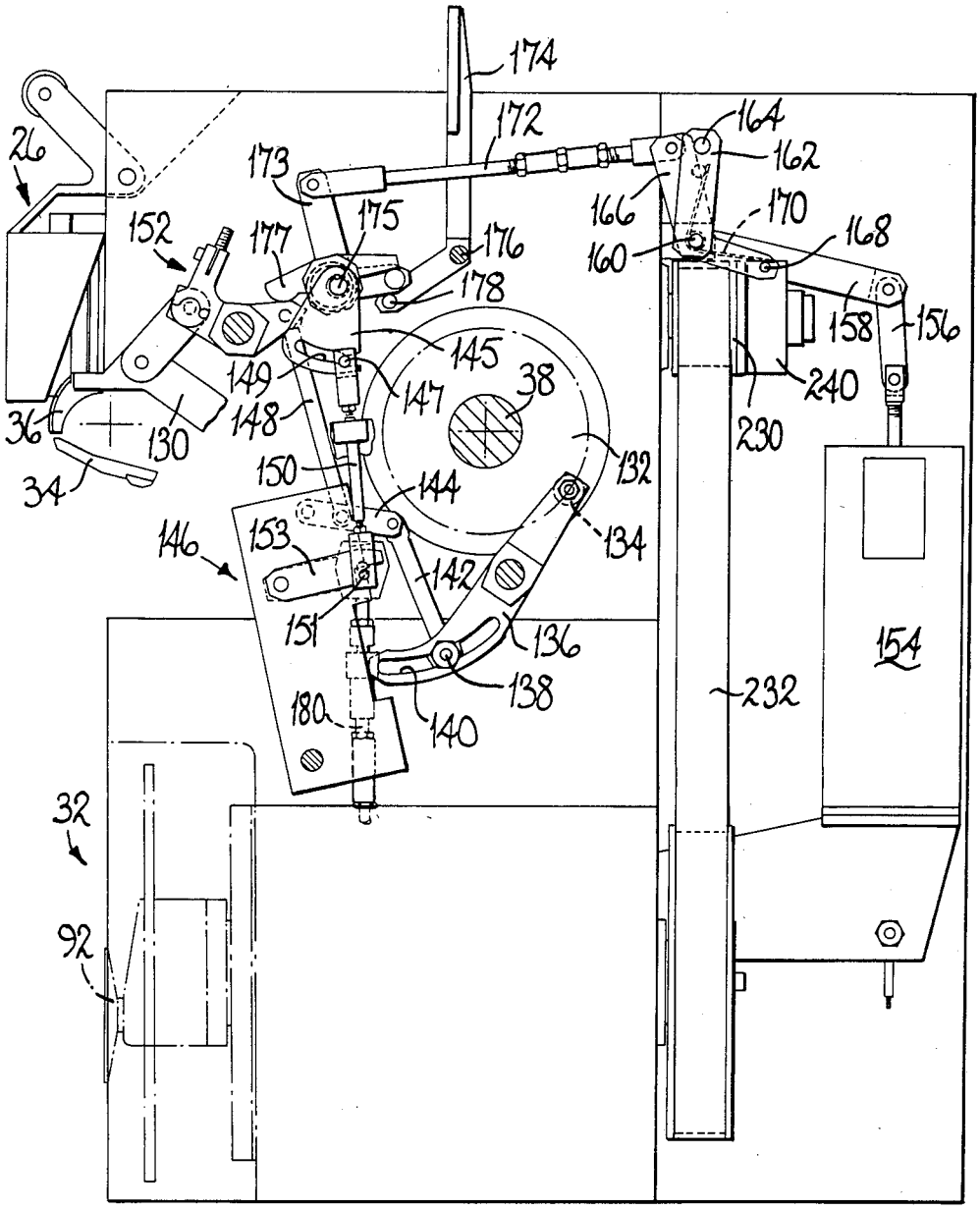
FIG. 2 is a section view of the machine, also taken from the right hand side and showing details of means for controlling the presser foot.

For lifting the presser foot 36 during the return (i.e. non-feeding) stroke of the worktable, a further cam 132 is provided on the crank shaft 38. As can be seen in FIG. 2, a cam follower 134 for the cam 132 is carried on the lever 136 pivoted intermediate its length on the machine frame, the other end of the lever being connected by a pin-and-slot connection 138, 140 to a link 142 which is in turn connected, by a further link 144, to a locking arrangement generally designated 146. This arrangement 146 serves to lock the presser foot 36, when the latter is in clamping engagement with a workpiece carried on the worktable 34, the arrangement being such that the presser foot is thus locked, regardless of the thickness of the work. Further for lifting the presser foot 36, the locking arrangement 146 is connected via a rod 148, which is connected, through a mechanism generally designated 152 to the lever 130 on which the presser foot 36 is carried.

For raising the presser foot 36 at the end of a stitching cycle, an electrically operated motor, in the form of a so-called linear actuator 154 is mounted on the machine frame, the actuator being connected via a link 156 to a lever 158 which is pivotally mounted on a transverse pin 160 in the machine frame. Also carried by the pin 160 is a lever 162 carrying an abutment pin 164, and further on the pin is a bell crank lever 166, one arm of which is engageable by the pin 164. The other arm of the bell crank lever 166 carries a further pin 168 which is engaged by a torsion spring 170 mounted on the pin 160 and fixed to the lever 162. The torsion spring 170 thus urges the bell crank lever 166 clockwise (viewing FIG. 2). The first-mentioned arm of the bell crank lever 166 is connected, via an adjustable rod 172, to a link 173 which is carried on a transverse pin 175, on which in turn is eccentrically mounted a pusher member 177. The pusher member 177 acts on the linkage 152, adjacent the pivotal connection with the rod 146, the arrangement being such that actuation of the actuator 154 is effective, through the linkage described above, to urge the mechanism 152 clockwise (viewing FIG. 2) and thus to raise the presser foot 36. Thus, actuation of the linear actuator 154, which takes place in response to an "end of cycle" signal being supplied, is effective, against the action of the torsion spring 170, to urge the presser foot 36 into clamping engagement with a workpiece supported by the worktable 34. De-actuation of said actuator 154, on the other hand, enables the spring 170 to return the presser foot to its raised, out-of-the-way position. It is to be noted that rotation of the pin 175 is also effective, through a cam member 145, and more especially through a pin (147) and slot (149) connection, to draw upwardly a rod 150 which carries a pin 151 co-operative with a lever 153 which is pivotally mounted in the locking arrangement 146 and serves, upon such pivotal movement being effected, to unlock the locking arrangement 146.

For emergency purposes, furthermore, in addition to the actuator 154, a manually operable bell crank lever 174 is provided, pivoted on a pin 176 carried in the machine frame, a lower arm of the lever carrying an abutment pin 178 engageable with the pusher member 177 of the presser foot actuating mechanism. Thus, the machine operator can, at any stage in the operating cycle of the machine, lift the presser foot 36 to its out-of-the-way position by actuation of the lever 174.

The locking of the locking arrangement 146 is achieved via a rod 180 which is operatively connected, at its upper end, to the lever 153 and, at its lower end, by a linkage generally designated 182, to a lever 184 carrying a cam follower 186 operatively engaged in a cam 188 mounted on a further cam shaft 190 (see FIG. 1) of the machine. The locking arrangement is unlocked after the presser foot 36 is raised by means of the cam 132 and prior to its being again lowered into engagement with the work.

The further cam shaft 190 is driven, through meshing gears 192 (one only shown in FIG. 1) carried on the cam shaft 190 and the shaft 88 (by which the so-called take-up arrangement 32 is driven). Thus, the cam shaft 190 effects a single rotation for each operating cycle of the machine and, furthermore, is driven synchronously with the crank shaft 38. Also mounted on the cam shaft 190, at one end thereof, is a crank (not shown) connected by a linkage with a rock shaft (also not shown) associated with the thread take-up arrangement 32 for modifying the action of the take-up roll 92.

For controlling the supply of running thread T2 to the take-up arrangement 32, the thread, after leaving a heated wax pot (if waxing is required), is entrained over a lower roll 194 (see FIG. 5), over a fixed intermediate roll 196 and then over an upper roll 198, thereafter passing on to the take-up roll 92 of the thread take-up arrangement 32. The lower and upper rolls 194, 198 each have associated therewith a thread clamping device for clamping the thread; thus, with sufficient running thread T2 supplied for the next stitch to be made, the lower thread lock is applied while the upper thread lock is released, while, after a stitch has been made, the upper lock is applied while the lower lock is released for drawing off a further quantity of thread from the supply for the next stitch to be made.

Figure 6:
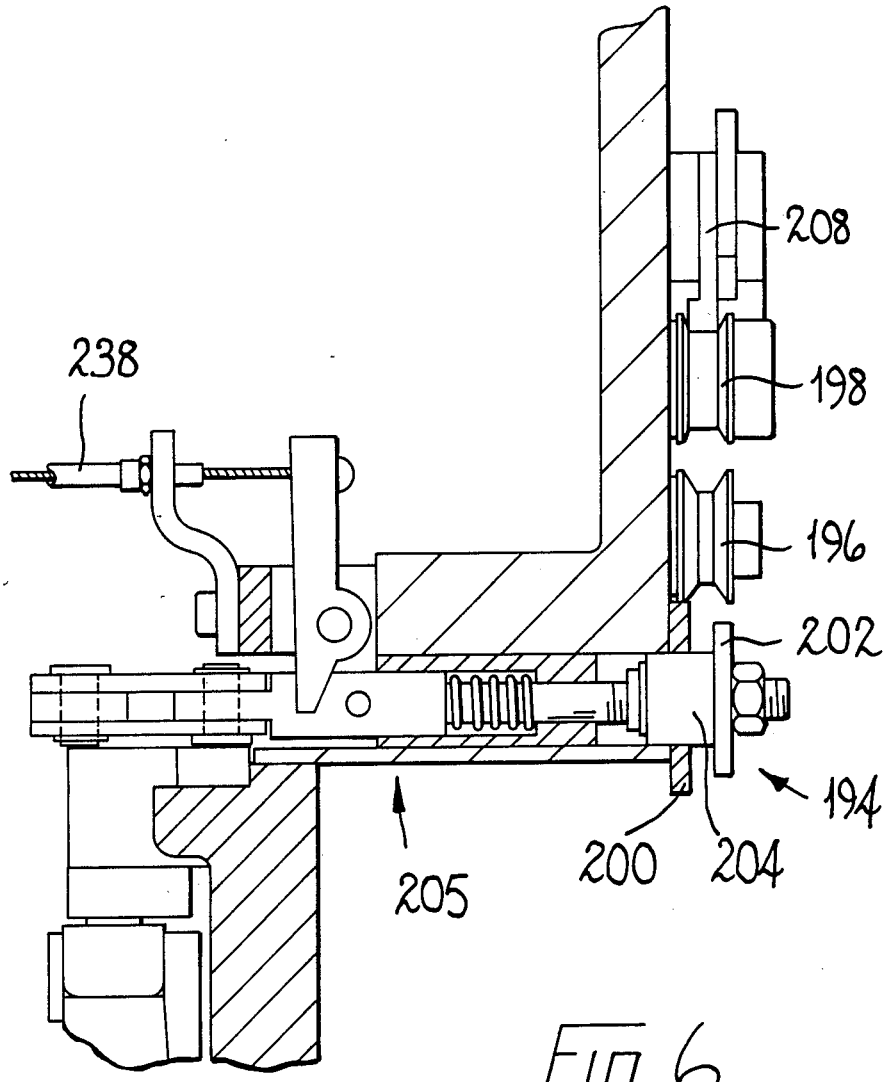
FIG. 6 is a fragmentary view in plan showing further details of the integers shown in FIG. 5.

The lower roll and lock (FIGS. 5 and 6) are constituted by two discs 200, 202 between which the thread T2 is entrained. One (200) of the discs which is fixed in relation to the machine frame and the other (202) is mounted on a spindle 204 slideable in the machine frame under the action of a cam-operated linkage generally designated 205, a cam 206 being carried on the shaft 88 of the take-up arrangement 32 for operating the linkage.

The upper lock comprises a shoe 208 which is shaped to clamp the thread T2 against the surface of the upper roll 198. Again, this shoe 208 is actuated by a cam-operated linkage generally designated 210, a cam 212 being mounted on the cam shaft 190 for operating this linkage.

For measuring the amount of thread to be supplied to the take-up arrangement 32 for each stitch to be made, a thread measuring roll 214 is arranged between the intermediate and upper rolls 196, 198. The thread measuring roll 214 is carried on an arm 216 which is pivotally mounted for rotation about an axis extending parallel with the shaft 88. The amount of movement of the thread measuring roll, in measuring thread for the next stitch to be made, is controlled by means of a cam 218 mounted on the shaft 88, but is modified according to the thickness of the work being operated upon, as sensed by the presser foot 36 when the latter is brought into clamping engagement with the work. This modification is achieved through a linkage by which the rod 180 is connected to the arm 214.

In the operation of the machine, each stitch is "set" in the work by the operation of the take-up roll 92; a stitch is "set" by drawing the stitch formed by the bobbin thread T1 and running thread T2 into the body of the work, customarily at approximately one third of the thickness work from the "needle" side thereof. In practice, the setting of each stitch takes place at the beginning of the formation of the next following stitch, so that at the end of a stitching cycle, the final stitch is not correctly set. The machine in accordance with the present invention therefore also comprises stitch setting means for setting this final stitch, the means comprising a roller 220 which is mounted on a cranked arm 222 pivoted, intermediate its length, on the machine frame, the arm 222 being pivotally connected at its other end to an output 224 of a solenoid 226, also mounted on the machine frame. The solenoid is actuated in response to an "end of cycle" signal and causes the roller 220 to engage the thread, between the lower and intermediate rolls 194,196 and to apply a tensioning draft to the running thread T2, which is at this time locked at the lower thread lock and roll 194. The effect of this action is to draw the running thread T2 downwardly, thereby drawing the lockstitch into the body of the work.

The shuttle drive comprises a straight shaft 228 extending fore-and-aft of the machine, the rear of the shaft carrying a timing pulley 230 which is connected by a timing belt 232 to a further timing pulley 234 carried on the rearward end of the cam shaft 190. The ratio between the pulleys 234,230 is 3:1 so that the shuttle effects three rotations for each single rotation of the shaft 190; it will of course be appreciated that only one of each three rotations of the shuttle is operable in the formation of a stitch, the 3:1 ratio being merely provided to give the required speed of rotation of the shuttle during stitch formation. In order to protect the shaft 228 in the event of disruption of the machine operation, a break-away clutch (not shown) is provided at the rearward end of the shaft.

The machine in accordance with the invention also comprises electronic control means by which the actuator 150, solenoid 226 and other elements of the machine operation can be controlled. The control means includes a shaft encoder 236 which is mounted at a rearward end of the shaft 88, the encoder being effective to ensure that, when the machine comes to rest, the needle 20 and awl 24 are clear of the work. To this end, when an "end of cycle" signal is supplied, by the operator releasing a treadle (not shown) also forming part of the control means, initially a brake (not shown) is applied to the output drive shaft of the motor, whereby the speed of rotation thereof, and thus of the various shafts 38,88,190 and 228 is reduced to "slow" speed (in casu about 100 rpm), whereafter the brake is released until the shaft encoder senses the stop position, the brake then being fully applied. Sensing the stop position is also effective to cause the stitch setting solenoid 226 to be actuated, thereby ensuring that the final stitch is properly set, the shoe remaining clamped by the presser foot 36 at this time. Upon signalling the actuation of the solenoid 226, furthermore, a timer (not shown) of the control means is energized, and this timer, upon timing out, causes the timer actuator 154 to be energized, whereby the presser foot lock 146 is released and the presser foot 36 is raised. At the same time, the actuator, through a Bowden cable connection 238 with the lower thread lock linkage 205, causes the lower thread lock to be released, so that the shoe can be removed from the worktable 34. The operator can then sever the leading end of the running thread T2.

The control means is also effective to control the temperature of the shuttle, which is of course maintained at elevated temperature for heating the shuttle thread T1. Similarly, where a wax pot is provided for the running thread T2, the temperature of this is similarly controlled.

We claim:

1. A lockstitch sewing machine comprising a worktable and a presser foot arranged at an operating locality of the machine for clamping a workpiece therebetween and for feeding such workpiece step-by-step through the operating locality;

a mounting for a curved hooked needle and a further mounting for a curved awl arranged in a common vertical plane and at opposite sides of the worktable, at the operating locality of the machine, and mounted for pivotal movement about a common axis, means for looping thread over the needle hook, after the latter has penetrated a workpiece being stitched and while it is projecting therethrough, retraction of the needle then causing the loop of thread to be drawn through the workpiece, means, including a rotatable shuttle, by which a lockstitch can be formed with said thread and a further thread, and means for thereafter drawing the lockstitch thus formed into the body of the workpiece, wherein the needle mounting and the awl mounting are caused to pivot each by a crank mechanism, and further wherein the mechanisms are mounted on a common crank shaft and each is operatively connected to its associated mounting through a bell crank lever arrangement, said arrangements being mounted on a common pivot arranged intermediate the crank shaft and the common axis of the mountings for the needle and awl.

2. A machine according to claim 1 wherein the crank shaft extends horizontally and transversely of the machine.

3. A machine according to claim 2 further comprising a mounting for a needle guide mounted for pivotal movement also about the common axis of the mountings for the needle and awl, and a cam arrangement mounted on the crank shaft and operatively connected through a linkage arrangement with the needle guide mounting for effecting pivotal movement thereof about said axis in timed relation with movement of the needle mounting.

4. A machine according to claim 3 wherein the crank shaft is driven, through an arrangement of timing pulleys operatively connected by a timing belt, by means of a braked motor, and further wherein the crank shaft supports a shaft encoder forming part of control means of the machine, by which means the operation of said motor is so controlled that the crank shaft is brought to rest, upon receipt of an "end of cycle" signal by the control means, with the mountings for the needle and awl so positioned that a needle and an awl respectively supported thereby are out of penetrating engagement with the workpiece.

5. A machine according to claim 4 wherein the means for looping thread over the needle hook comprises a looper through an aperture of which the thread passes, said looper being mounted for pivotal movement about an axis inclined at some 25° to the vertical.

6. A machine according to claim 5 wherein cam means is provided on the crank shaft for effecting pivotal movement of the looper as aforesaid, said means being operatively connected to the looper by a toothed segment arrangement.

7. A machine according to claim 6 comprising cam-operated means for bringing the presser foot into clamping engagement with a workpiece supported by the worktable and for supporting it against the thrust of the awl as the latter penetrates the workpiece in the operation of the machine, said means comprising a lock arrangement which, in an unlocked condition, allows relative sliding movement between components thereof whereby the cam-operated means can accommodate to the thickness of the workpiece being clamped, but which, in locked condition, locks the components against such movement, and an electrically operated linear motor operable through a linkage arrangement, in response to an "end of cycle" signal, to raise the presser foot out of such clamping engagement, at the end of a stitching operation, and to cause the lock arrangement to be released.

8. A machine according to claim 7 wherein the linear motor is operated after the crank shaft has been brought to rest as aforesaid.

9. A machine according to claim 8 wherein means for supplying thread to the needle is provided comprising first thread clamping means operable in conjunction with a thread measuring device and arranged "downstream" of the latter, the arrangement being such that said clamping means is operated to clamp the thread while a measured quantity is drawn from a supply thereof by the measuring device, and second thread clamping means, arranged "upstream" of the first clamping means, for clamping the thread after the measured quantity has been drawn as aforesaid, said second means remaining in thread clamping condition during stitch formation, during which the first means leaves the thread unclamped, and further wherein the linear motor serves also to release the second thread clamping means in response to said "end of cycle" signal.

10. A machine according to claim 9 wherein the linear motor is connected to the second thread clamping means directly through a Bowden cable arrangement.

11. A machine according to claim 10 wherein a thread take-up arrangement is provided by which the quantity of thread drawn from a supply as aforesaid is controlled during stitch formation, and by which also a formed stitch can be drawn into the body of the workpiece as aforesaid, by pulling on the needle thread while the latter is held clamped by the second thread clamping means, such drawing of the formed stitch taking place as the awl is moved into penetrating engagement with the workpiece at the start of the formation of the next stitch, and also wherein, for the final stitch formed in a machine cycle, stitch setting means is provided which, in response to the "end of cycle" signal, is caused to pull on the needle thread to draw the formed stitch into the body of the workpiece as aforesaid, the arrangement being such that the second thread clamping means is released as aforesaid only after the operation of the stitch setting means is completed.

12. A machine according to claim 11 wherein the stitch setting means is operated by an electrically operated motor.

* * * * *